US006655472B1

(12) United States Patent
Humm et al.

(10) Patent No.: US 6,655,472 B1
(45) Date of Patent: Dec. 2, 2003

(54) DEVICE FOR PRODUCING AN ABRUPT FEED MOTION

(75) Inventors: Siegfried Humm, Schoental-Westernhausen (DE); Dirk Schroeter, Kupferzell (DE)

(73) Assignee: Adolf Wuerth GmbH & Co. KG, Kuenzelsau (DE)

( * ) Notice: Subject to any disclaimer, the term of this patent is extended or adjusted under 35 U.S.C. 154(b) by 0 days.

(21) Appl. No.: 09/700,605

(22) PCT Filed: May 15, 1999

(86) PCT No.: PCT/EP99/03363

§ 371 (c)(1),
(2), (4) Date: Jul. 12, 2001

(87) PCT Pub. No.: WO99/59779

PCT Pub. Date: Nov. 25, 1999

(30) Foreign Application Priority Data

May 16, 1998 (DE) ..... 198 22 081

(51) Int. Cl.[7] ..... B25D 17/00

(52) U.S. Cl. ..... 173/202

(58) Field of Search ..... 173/20, 202, 204; 227/8, 10, 130, 142

(56) References Cited

U.S. PATENT DOCUMENTS

| | | | | |
|---|---|---|---|---|
| 1,497,635 A | | 6/1924 | Parrish | |
| 2,543,942 A | * | 3/1951 | Shaff | 227/147 |
| 2,792,571 A | | 5/1957 | Klopstock | |
| 3,297,224 A | * | 1/1967 | Osboorne | 227/10 |
| 3,802,617 A | * | 4/1974 | Berecz | 227/112 |
| 3,803,840 A | | 4/1974 | Toczycki | |
| 4,909,419 A | * | 3/1990 | Yamada et al. | 227/1 |
| 5,720,423 A | | 2/1998 | Kondo et al. | |

FOREIGN PATENT DOCUMENTS

| | | |
|---|---|---|
| DE | PS154945 | 10/1904 |
| DE | 3237087 | 4/1984 |
| DE | 3445279 | 6/1986 |
| DE | 3728454 | 3/1989 |
| DE | 3730049 | 3/1989 |
| GB | 2171351 | 8/1986 |
| GB | 2250906 | 6/1992 |

* cited by examiner

*Primary Examiner*—Stephen F. Gerrity
*Assistant Examiner*—Chukwurah Nathaniel
(74) *Attorney, Agent, or Firm*—Quarles & Brady LLP

(57) ABSTRACT

A device for producing an abrupt or sudden feed motion contains in a casing a feed device, which can be triggered by a trigger. The force necessary for advancing the feed device is applied by a spring, which is tensioned with the aid of a drive. The tool requires no cartridges for propellant charges.

19 Claims, 2 Drawing Sheets

DEVICE FOR PRODUCING AN ABRUPT FEED MOTION

Figure 1:
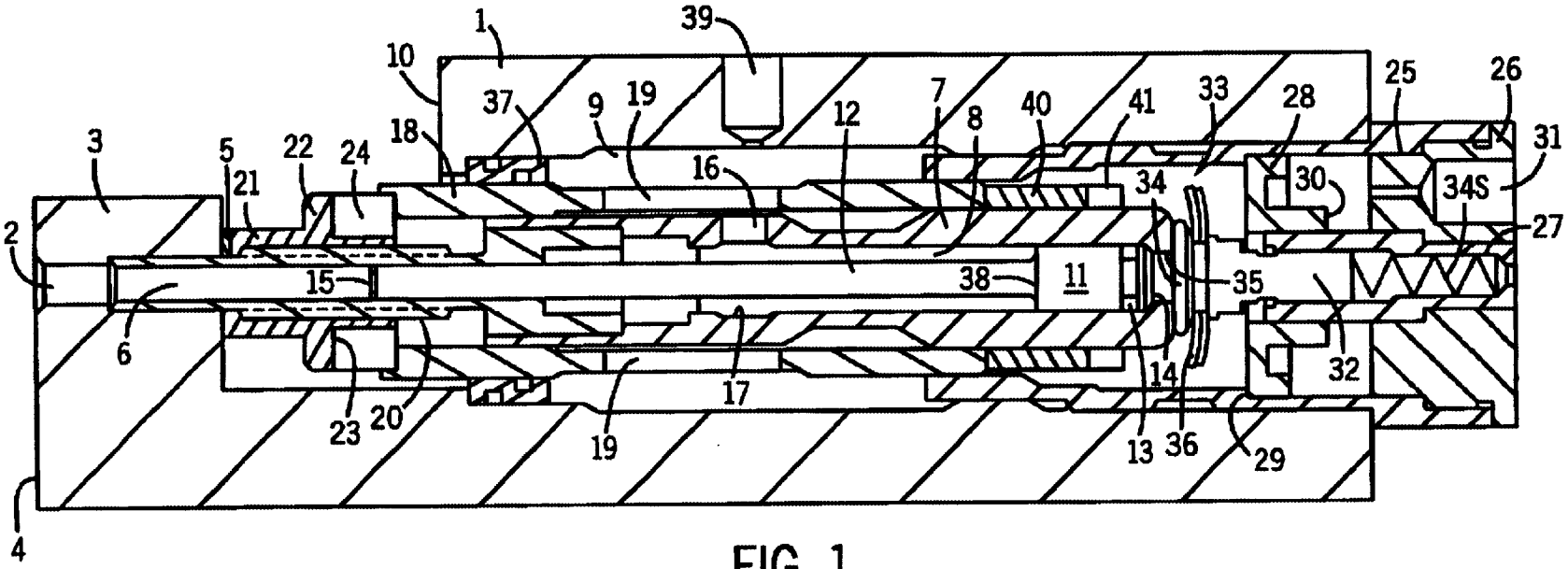

The invention is based on a bolt pushing tool with which steel bolts can be inserted in hard material, e.g. concrete for fixing articles. The known bolt pushing tools make use of a propellant charge for producing the feeding or advance force, said charge being ignited and as a result of the explosive gases released a piston is driven. The piston then acts on the head of the bolt and pushes it out of the tool.

Numerous tools exist with which clips or nails are driven in. Such tools are known in the form of compressed air tackers or electrical tackers. However, these are not able to produce the characteristic force for bolt pushing tools.

The problem of the invention is to further improve a device for producing an abrupt or sudden feed motion with respect to the safety of handling. The device must e.g. be usable as a drive for a bolt pushing tool.

For solving this problem the invention proposes a device having the features of claim 1. Further developments of the invention form the subject matter of dependent claims, whose wording like that of the abstract is, by reference, made into part of the content of the description.

Whereas in the case of the known bolt pushing tools working always takes place with explosions, the device proposed by the invention can be operated with a motor drive, which has a lower safety risk. In addition, it is no longer necessary for the user to carry with him and store propellant charge magazines. The drive can e.g. be an electric motor, so that the tool can be operated and handled in the same way as a conventional portable drilling machine. The energy can be supplied by a battery. According to the invention the tool uses the motor drive in order to relatively slowly tension the striker spring. The completely tensioned spring is able to produce an adequately powerful feed or advance in order to e.g. drive a bolt with the same action into the substrate as in the case of the existing explosion-operated tools.

The feed device, which transfers the force of the relaxing spring, can e.g. have a push rod. This push rod can be guided in a corresponding guide and means can be provided in order to decelerate the end of the movement of the push rod if it has excessive energy.

According to a further development of the invention, the device also has a return mechanism for sliding back the feed device from the impact position into the starting position after performing the impact process. This ensures that the device automatically and rapidly returns to its starting position, so that it can be continuously used by a user. As the sliding back of the feed device can be carried out more slowly and with reduced force, the return mechanism can also be operated by the drive. However, it is also possible to give the return mechanism a spring.

It is particularly favourable if the spring element of the spring for performing the impact process and/or the spring element of the return spring is a pressurized gas. In this case the actual spring element has a negligibly low weight, so that the spring can very rapidly relax with a high force.

It can in particular be provided that the feed device has a piston on which the spring element directly acts. For example the push rod can be connected to a piston or constructed in one piece therewith and then the pressurized gas acts directly thereon. The push rod can also comprise several parts.

The piston can in particular be a double-acting piston on which the return spring acts directly.

According to a further development of the invention, the proposed device can have an axial piston guide.

The trigger for triggering the fitting or installation process can in particular have a valve, on whose operation the pressurized gas commences the impact process.

It can in particular be provided that the valve is opened for triggering the impact process.

The invention also proposes constructing the valve in such a way that it has a self-reinforcing opening movement. This ensures that the valve opens very rapidly as soon as it is triggered.

The invention proposes the spring-loading of the valve in the closed position. On triggering the insertion process it is consequently necessary to firstly overcome the spring tension with which the valve is urged into the closed position. This can be used for making the valve opening process jerky.

The trigger for triggering the insertion process can, according to the invention, be designed in such a way that it is triggered by the drive on reaching a specific position, which simplifies the handling of the tool.

It can be provided according to the invention that the striker spring is already pretensioned in the starting position of the feed device.

According to a further development of the invention the drive is constructed in such a way that during its operation, in order to initiate an impact process, the striker spring further tensions directly prior to triggering. Therefore the spring does not constantly have to be under maximum tension.

It is also possible to construct the drive in such a way that following the advance of the feed device the striker spring is temporarily further relaxed to facilitate its sliding back.

According to the invention the drive has a tubular element arranged coaxially to the piston guide and displaceable in the longitudinal direction of said piston guide. This makes the construction of the tool compact. Simultaneously the tubular element is guided on the piston guide.

For the displacement of the tubular element it is possible to place on an external thread of the bolt guide a rotatable nut, which during its use displaces by means of a bearing the tubular element.

Further features, details and advantages of the invention can be gathered from the following description of a preferred embodiment of the invention and the attached drawings, wherein show:

FIG. 1 A longitudinal section through an embodiment of a device proposed by the invention using the example of a bolt pushing tool.

Figure 2:
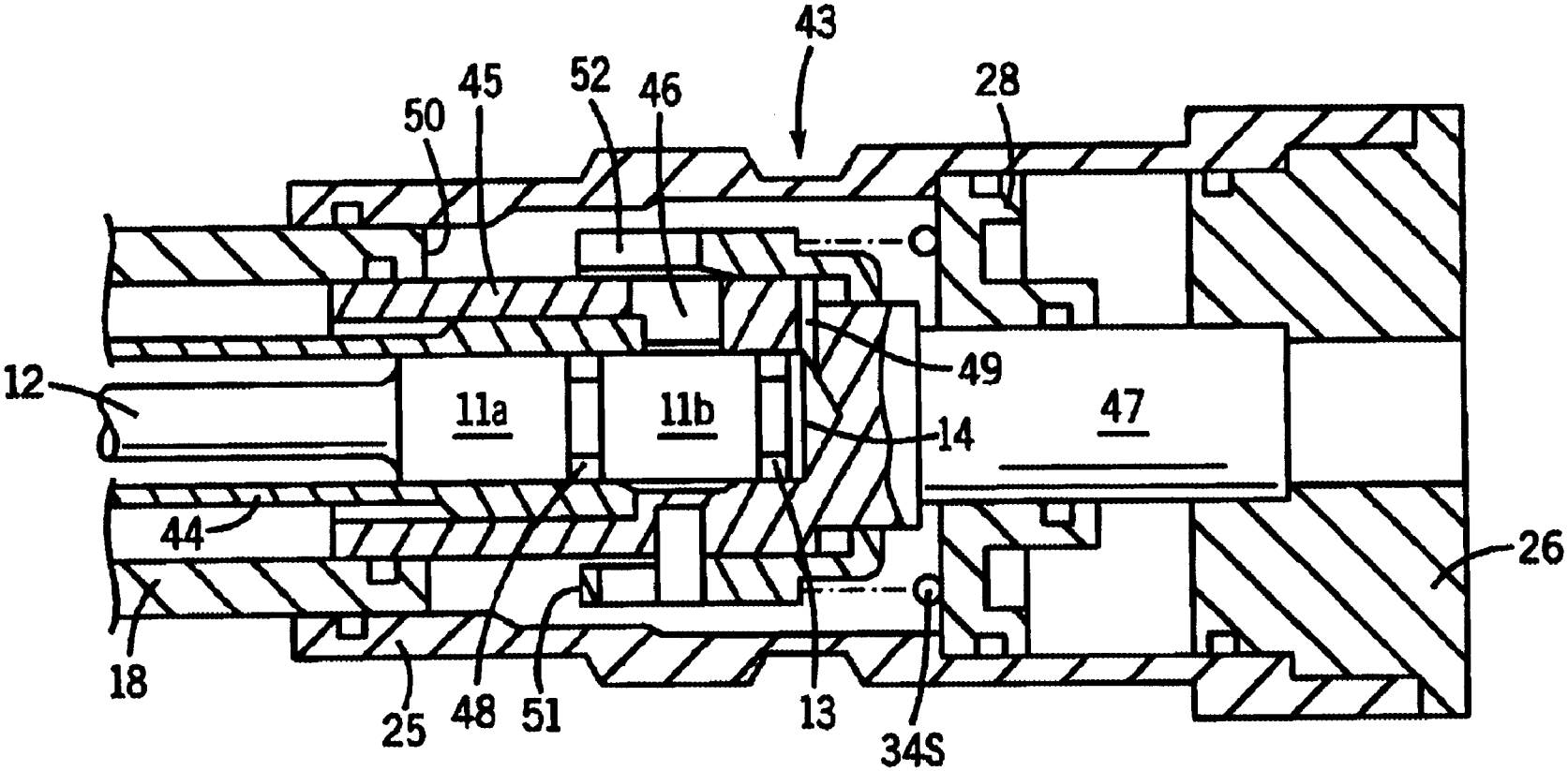

FIG. 2 A partial section through the right-hand part of the bolt pushing tool in FIG. 1 in a second embodiment.

FIG. 1 diagrammatically shows a longitudinal section through a bolt pushing tool, which implements the invention. The bolt pushing tool contains an only diagrammatically represented casing 1. The casing 1 has at its left-hand end in FIG. 1 a bore 2 permitting the introduction of a bolt to be fitted using said tool and from which it can be driven out again. The bore 2 is located in a leg 3 of the casing 1. In the end of the bore 2 opposite to the left-hand end face 4 is inserted, preferably screwed a piston guide 5, which is roughly tubular and contains in its interior a cylindrical channel 6 for the bolt to be fitted. On the end of the bolt guide 5 remote from the bore 2 is screwed a piston guide 7, which contains a cylindrical cavity 8, which is positioned coaxially to the cylindrical cavity 6 of the bolt guide.

The casing 1 contains a substantially cylindrical cavity 9, which terminates at a certain distance upstream of the web 3. Between the web 3 and a surface 10 of the casing 1 bounding the cavity 9 is provided a space through which a motor, which is not shown in the drawing and optionally having a trans-mission, can act on the tool.

In the cylindrical cavity 8 of the piston guide 7 is longitudinally displaceably guided a piston 11, which is constructed in one piece at one end of a push rod 12. The piston contains a groove 13 for housing a seal. With its free end 14 it engages on the shoulder, formed by a constriction, at the end of the piston guide 7. The free end 15 of the push rod 12 remote from the piston 11 is located in the bolt guide 5 and is intended to act on the head of a bolt to be fitted.

In the cylindrical jacket of the piston guide 7 is provided an outwardly leading opening 16. In the vicinity of said opening on the inside of the cavity 8 is formed an enlargement 17.

A tubular element 18 is longitudinally displaceably mounted on the outside of the piston guide 7. This tubular element 18 also has openings or perforations 19, which permit a connection between the cavity 8 within the piston guide 7 and the cavity 9 of the casing 1. These perforations are present at several points on the circumference of the tubular element 18.

Over part of its length the outside of the bolt guide 5 is provided with an external thread 20, which is intimated in the drawing. Onto the external thread 20 is screwed a nut 21, which has a flange 22 located in a radial plane. Between the end face 23 of the flange 22 of the nut 21 facing the tubular element 8 and the latter is inserted a ball bearing 24. Action can take place from the outside on the nut 21 through the drive in order to rotate or turn the same. During its rotation it simultaneously longitudinally slides the bolt guide 5 and this motion is transferred via the ball bearing 24 to the tubular element 18.

From the side opposite to the web 3 a sleeve 25 is screwed into the cylindrical cavity 9 of the casing 1. For reasons of simplification the drawing omits the seals between the sleeve 25 and the casing 1. On its outwardly directed end the said sleeve 25 is closed in sealed manner by a disk 26. The opposite, inner end of the sleeve 25 is coaxial to the tubular element 18, which is sealed with the aid of a not shown seal with respect to the inside of the end of the sleeve 25. Thus, the tubular element 18 is sealed both with respect to the outside of the piston guide 7 and with respect to the inside of the sleeve 25. As a result the cavity 9 of the casing on the left-hand side of the sleeve 25 in FIG. 1 and the cavity of the sleeve 25 are separated from one another in sealed manner.

The disk 28 is centrally provided with a guide sleeve 27 screwed into it and projecting inwards into the sleeve 25 via the disk 26. On said guide sleeve 27 is displaceably guided a-disk 28 sealed by not shown seals. The maximum displacement of the disk 28 is until it engages on a shoulder 29 on the inside of the sleeve 25, as shown in FIG. 1. In the reverse direction the disk 28 can be displaced until its end face 30 engages on the disk 26. The space between the disk 28 and the disk 26 contains a pressurized gas, which is introduced into the space by means of an inlet 31 equipped with a valve. For simplification reasons the valve is not shown. The pressurized gas urges the disk 28 into the position shown.

In the interior of the guide sleeve 27 is displaceably guided a shaft 32 of a release valve 33. In the position shown the shaft 32 is subject to the action of a compression spring 34s. Sealing takes place between the shaft 32 and the inside of the guide sleeve 27. On the shaft 32, within the space in the sleeve 25, is located a valve disk 34, whose external diameter is somewhat smaller than the external diameter of the piston guide 7, but larger than the opening 35 located in the associated end of the piston guide 7. The valve 33 closes this opening 35. Immediately behind the valve disk 34 are provided two disk springs 36, whose external diameter is larger than the external diameter of the piston guide 7.

The tubular element 18 is not only sealed with respect to the sleeve 25 in the right-hand part in FIG. 1, but also in the area of the surface 10 with respect to the casing 1 with the aid of a thrust ring 37 and with respect to the piston guide 7. In the vicinity of its outside the tubular element 18 is constructed in such a way that this external and internal sealing action not only occurs in the position shown, but also when the tubular element 18 is moved away from the web 3 in the direction of the disk 26.

The cavity 9 of the casing contains pressurized gas, which is optionally permeated with a specific quantity of oil. The resulting pressure prevails not only outside the tubular element 18 but, due to the perforations 19 and opening 16, also in the interior of the piston guide 7. As the diameter of the push rod 12 is smaller than the internal diameter of the piston guide 7, said pressure is present on the underside 8 of the piston 11 and urges it into the position shown. A connection 39 is provided in the outer wall of the casing 1 for introducing the pressurized gas.

The space within the sleeve 25 between the disk 28 and the end of the piston guide 7 is filled with oil. The release valve 33 is closed by the compression spring 34s. Thus, the oil in the space within the sleeve 25 cannot reach the piston 11. The position shown in the drawing in which the piston 11 has moved up to the end of the piston guide 7 and the tubular element 18 is moved into the maximum possible position in the opposite direction, represents the starting position.

In the starting position shown the space within the sleeve 25 is filled with oil. For initiating a fitting or insertion process the drive is operated, i.e. for example an electric motor is switched on and with the aid of a transmission rotates the nut 21 with respect to the bolt guide 5. This rotation leads to a simultaneous longitudinal displacement of the tubular element 18. In the vicinity of its end facing the release valve 33, the tubular element 18 has a spacer 40, which contains lateral recesses 41. The advance of the tubular element 18 into the oil-filled space within the sleeve 25 leads to a tensioning of the gas spring between the disk 28 and the disk 26. On reaching a given position the terminal edge of the spacer 40 engages on the disk springs 36. A further movement now leads to a deformation of the disk springs. On reaching a given position the valve disk 34 is raised from the opening 35 of the piston guide 7. The entire pressure of the oil now acts on the surface of the valve disk 34 and the end face 14 of the piston 11. As a result the valve is opened in jerky manner and the piston 11 is driven in the direction of the bolt guide 5. The pressure is so high that the resulting momentum is adequate for fitting the bolt. During this forward movement of the feed device formed by the piston 11 and the push rod 12, the pressure in the cavity 9 increases relatively slowly due to the larger size of the space. As a result of this pressure increase the piston 11 is subsequently moved back again. In the intermediate period the tubular element 18 has been further displaced, so that the release valve 33 has also somewhat displaced the disk 28. This leads to a certain increase in the size in the space within the sleeve 25, so that the return for moving the piston 11 is facilitated. The tubular element 18 then moves in the reverse direction back into the starting position shown.

In the case of the embodiment according to FIG. 2 the piston guide is constructed in two parts in the area facing the release valve 43. Onto the end of an inner tube 44, in which the piston 11 is guided together with the push rod 12, is screwed a sleeve element 45, which in the axial extension of the piston is provided on its outside with a guide shoulder 45 and on the latter, which corresponds to the guide sleeve in the embodiment of FIG. 1, is guided the disk 28.

The sleeve element has radial openings 46. The piston 11 has two piston sections 11*a*, 11*b*, which are separated from one another by a groove 48 for a seal. In the starting position shown the opening 46 is positioned roughly centrally to the piston section 11*b*. Beyond the end face 14 of the piston a radially directed, lateral, small opening 49 leads into the bottom of the sleeve 45.

The release valve 43 has a sleeve-like construction and embraces the radial outside of sleeve element 45, being urged into the closed position by a spring 34*s*. The pressure prevailing in the space within the sleeve 25 admittedly passes through the openings 46 to the piston section 11*b*, but cannot attain any feed action there, because it does not reach the end face 14 of the piston. As soon as the displacement of the tubular element 18, whose end face 50 engages on the opposite end face 51 of the release valve 43, it has been moved to such an extent that the recesses 52 free the radial, small opening 49, the pressure now also prevails on the end face 14. The piston is driven forwards and as soon as the seal located in the groove has reached the opening 46, the piston movement is further accelerated, because now the entire cross-section of the opening 46 is available.

EXAMPLE

For driving nails into steel a force of approximately four tonnes is required, for concrete approximately two tonnes and for wood approximately one tonne.

The piston speed reaches values of 40 to 50 meters per second.

The spring tensioning time is approximately 0.1 second, whereas the relaxing of the spring takes place in roughly one millisecond.

What is claimed is:

1. Device for producing an abrupt feed motion, having a casing (1), a feed device, which is movable between a retracted starting position and an advanced impact position, said feed device being connected to a piston and having an axial piston guide (7) for guiding the piston, a striker spring, which can move the feed device from the starting position into the impact position, and a drive for tensioning the striker spring, and a trigger for releasing the drive and the tensioned striker spring, said trigger comprising a displaceable tubular element (18) positioned coaxially to the piston guide (7) and moveable relative to the piston guide (7) for triggering the tensioned striker spring.

2. Device according to claim 1, wherein the feed device has a push rod (12).

3. Device according to claim 1, with a return mechanism for sliding back the feed device from the impact position into the starting position after performing the impact process.

4. Device according to claim 3, wherein the return mechanism has a return spring.

5. Device according to claim 4, wherein the return spring has a spring element which is a pressurized gas.

6. Device according to claim 1, wherein the striker spring has a spring element which is a pressurized gas.

7. Device according to claim 6, wherein the spring element of the striker spring acts directly on the piston (11).

8. Device according to claim 7, wherein the piston (11) is a double-acting piston, on which the spring element of the return spring directly acts.

9. Device according to claim 1, wherein the trigger has a valve (33, 43).

10. Device according to claim 9, wherein the valve (33, 43) is opened for initiating the impact process.

11. Device according to claim 9, wherein the valve (43, 33) is constructed in such a way that the valve has a self-reinforcing opening movement.

12. Device according to claim 11, wherein the valve (33, 43) is spring-loaded in the closed position.

13. Drive according to claim 1, wherein the drive is constructed in such a way that the drive can operate the trigger.

14. Drive according to claim 1, wherein the striker spring is pretensioned in the starting position of the feed device.

15. Drive according claim 1, wherein the drive is constructed in such a way that during operation the drive further tensions the striker spring prior to triggering.

16. Device according to claim 1, wherein the tubular element (18) is displaceable with the aid of a rotatable nut (21) located on a thread (20) of the bolt guide (5).

17. Device for producing an abrupt feed motion, having a casing (1), a feed device, which is movable between a retracted starting position and an advanced impact position, a striker spring, which can move the feed device out of a starting position and into the impact position, a drive for tensioning the striker spring, as well as with a trigger for releasing the tensioned striker spring, in which the feed device is connected to a piston (11), the device has an axial piston guide (7), wherein the drive has a dispensable tubular element (18) positioned coaxially to the piston guide (7) and which triggers the tensioned striker spring, and wherein the drive is constructed in such a way that following the advance of the feed device the drive further relaxes the setting spring to facilitate the sliding back thereof.

18. Device for producing an abrupt feed motion, having a casing (1), a feed device, which is movable between a retracted starting position and an advanced impact position, a striker spring, which can move the feed device out of a starting position and into the impact position, a drive for tensioning the striker spring, as well as with a trigger for releasing the tensioned striker spring, in which the feed device is connected to a piston (11), the device has an axial piston guide (7), wherein the drive has a displaceable tubular element (18) positioned coaxially to the piston guide (7) and which triggers the tensioned striker spring, and wherein the casing (1) contains a bolt guide (5) for a bolt to be fitted using the device and the latter is constructed as a bolt pushing tool.

19. Device for producing an abrupt feed motion, having a casing (1), a feed device, which is movable between a retracted starting position and an advanced impact position, a striker spring, which can move the feed device out of a starting position and into the impact position, a drive for tensioning the striker spring, as well as with a trigger for releasing the tensioned striker spring, in which the feed device is connected to a piston (11), the device has an axial piston guide (7), wherein the drive has a dispensable tubular element (18) positioned coaxially to the piston guide (7) and which triggers the tensioned striker spring, and wherein in addition to the abrupt feed motion, at least in part of the motions a rotary movement is performed.

* * * * *

UNITED STATES PATENT AND TRADEMARK OFFICE

CERTIFICATE OF CORRECTION

PATENT NO. : 6,655,472 B1
DATED : December 2, 2003
INVENTOR(S) : Humm et al.

It is certified that error appears in the above-identified patent and that said Letters Patent is hereby corrected as shown below:

Column 2,
Line 67, “trans-mission” should be -- transmission --.

Column 6,
Line 65, “motions” should be -- motion --.

Signed and Sealed this

Twenty-sixth Day of July, 2005

JON W. DUDAS
*Director of the United States Patent and Trademark Office*